US008668525B1

(12) United States Patent
Tu et al.

(10) Patent No.: US 8,668,525 B1
(45) Date of Patent: Mar. 11, 2014

(54) METHOD OF FORMING COLORED APPEARANCE AND CONDUCTIVE CASING

(75) Inventors: Chih-Wei Tu, Taoyuan County (TW); I-Cheng Chuang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 15 days.

(21) Appl. No.: 13/586,873

(22) Filed: Aug. 16, 2012

(51) Int. Cl.
*H01R 13/648* (2006.01)

(52) U.S. Cl.
USPC ..... 439/607.36; 439/488; 439/931

(58) Field of Classification Search
USPC ..... 439/607.36, 607.35, 607.4, 931, 488, 439/491
See application file for complete search history.

(56) References Cited

U.S. PATENT DOCUMENTS

| | | | | |
|---|---|---|---|---|
| 8,142,220 | B2 * | 3/2012 | Burns | 439/488 |
| 8,246,383 | B2 * | 8/2012 | Schmidt et al. | 439/607.35 |
| 8,500,495 | B2 * | 8/2013 | Wang et al. | 439/660 |
| 2006/0105619 | A1 * | 5/2006 | Lanni | 439/488 |

* cited by examiner

*Primary Examiner* — Gary Paumen
(74) *Attorney, Agent, or Firm* — Jianq Chyun IP Office

(57) ABSTRACT

A method of forming a colored appearance suitable for forming a colored appearance for a conductive casing of a connector is provided. The conductive casing has a body and at least one lead. The lead extends from the body. The method of forming a colored appearance includes the following steps. A surface of the conductive casing is roughened. A conductive metal layer is formed on the roughened surface of the conductive casing. A shielding layer is formed on a part of the conductive metal layer located on the lead. A colorful conductive layer is formed on the conductive casing. The shielding layer and a part of the colorful conductive layer located on the shielding layer are removed to expose the part of the conductive metal layer on the lead. Therefore, the conductive casing has a colored appearance.

11 Claims, 6 Drawing Sheets

METHOD OF FORMING COLORED APPEARANCE AND CONDUCTIVE CASING

BACKGROUND

1. Field of the Application

The application is directed to a method of forming a colored appearance and a conductive casing and more particularly, to a method of forming a colored appearance of a connector and a conductive casing suitable for a connector.

2. Description of Related Art

With the continuous advancement and improvement of electronic technology in recent years, electronic devices such as mobile phones, tablet computers, notebook computers or the like are extensively used and trend to develop to be convenient, multi-functioned and artistic designed so as to provide much more choices for customers. An electronic produce is typically equipped with at least one connector on a circuit board therein, and a part of the connectors have leads so that the connectors are welded on the circuit board through the leads.

Among these connectors, some of the connectors are externally exposed from the electronic product to be used as input/output ports so that an external device may be connected with the electronic product via such type of connector. Meanwhile, since the connector is made of a material that is different from the casing of the electronic product, which leads to a difference between a color of the connector and a color of the casing of the electronic product. When the connector is externally exposed from the electronic product, the appearance of the electronic product is influenced. Thus, to provide such connector with a color that is similar to the appearance of the electronic product has gradually become one of the technologies to be concerned.

In the related art, some colored materials may allow the connector to have a colored appearance. Beside coating the colored material on the surface of the connector to provide the connector with a colored appearance, it is more important to maintain the conductivity function as the casing of the connector originally has. On the other hand, some of the colored materials have the conductivity, but can not be bonded with solder well. Thus, if the colored material is attached to the leads of the connector, the leads of the connector are unable to be stably welded on the circuit board. As a result, the connector is loosened or can not be effectively connected with the circuit board.

SUMMARY

The application is directed to a method of forming a colored appearance. By the method, a conductive casing of a connector is provided with the colored appearance, and the conductive casing having good conductivity and weldability is maintained.

The application is directed to a method of forming a colored appearance, which is suitable for forming a colored appearance for a conductive casing of a connector. The conductive casing has a body and at least one lead. The lead extends from the body. The conductive casing is suitable for being welded on a circuit board through the lead. The method of forming the colored appearance includes the following steps. A surface the conductive casing is roughened. A conductive metal layer is formed on the roughened surface of the conductive casing. A shielding layer is formed on a part of the conductive metal layer located on the lead. A colored conductive layer is formed on the conductive casing, wherein a part of the colored conductive layer is located on the conductive metal layer of the body, and the other part of the colored conductive layer is located on the shielding layer located on the lead. The shielding layer and the part of the colored conductive layer located on the shielding layer are removed to expose the other part of the conductive metal layer located on the lead.

In an embodiment of the application, the step of forming the conductive metal layer includes electroplating the conductive metal layer.

In an embodiment of the application, the step of forming the shielding layer includes coating a plating-resist material.

In an embodiment of the application, the step of forming the colored conductive layer includes electroplating a colored conductive material The application is further directed to a conductive casing suitable for a connector, which has a colored appearance. The conductive casing includes a body, at least one lead, a conductive metal layer and a colored conductive layer. The lead extends from the body. The conductive casing is suitable for being welded on a circuit board through the lead. The conductive metal layer is located on the conductive casing, wherein a part of the conductive metal layer is located on the body, and the other part of the conductive metal layer is located on the lead. The colored conductive layer is located on the body and covers the part of the conductive metal layer located on the body.

In an embodiment of the application, a material of the colored conductive layer includes metal.

In an embodiment of the application, a material of the colored conductive layer comprises black nickel.

In view of the foregoing, the application is directed to a method of forming a colored appearance. In the method, a conductive metal layer is formed on a roughened surface of a conductive casing of a connector, and a shielding layer is formed on a conductive metal layer located on at least one lead. After the colored conductive layer is formed on the conductive casing, the shielding layer is removed and a part of the conductive metal layer located on the lead is exposed. Accordingly, the conductive casing of the connector has a colored appearance and good conductivity. Meanwhile, the leads thereof are disposed on where good weldability is provided for the connector being welded on the circuit board through the leads.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the present application, and are incorporated in and constitute a part of this specification. The drawings illustrate embodiments of the present application and, together with the description, serve to explain the principles of the present application.

DESCRIPTION OF EMBODIMENTS

Figure 1:
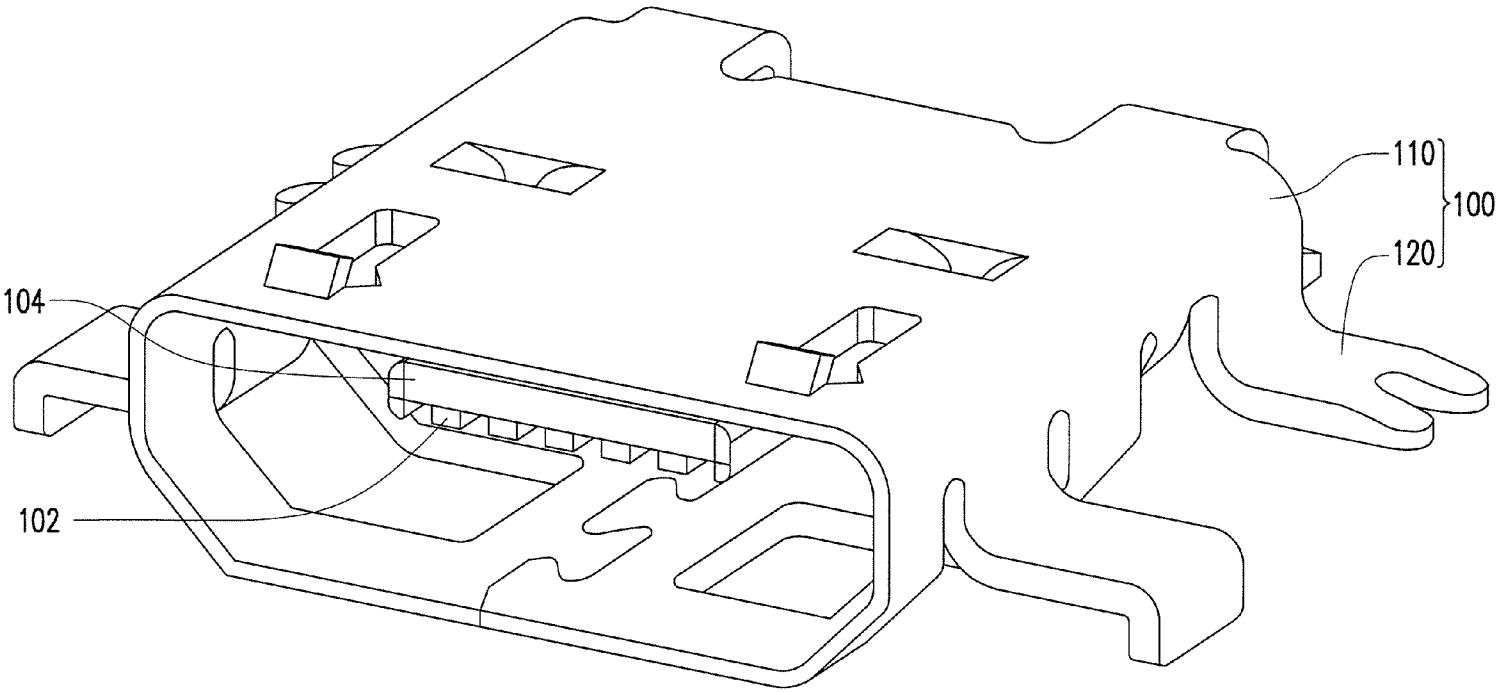
FIG. 1 is a perspective view showing a connector to be added with a colored appearance according to an embodiment of the application.

FIG. 1 is a perspective view showing a connector to be added with a colored appearance according to an embodiment of the application. Referring to FIG. 1, in the present embodiment, a connector 50 has a conductive casing 100, conductive terminals 102 and an insulation body 104. The conductive terminals 102 are disposed on the insulation body 104. The conductive terminals 102 and the insulation body 104 are located in the conductive casing 100. The conductive casing 100 has a body 110 and at least one lead 120. The lead 120 extends from the body 110. The conductive casing 100 of connector 50 is welded on a circuit board through the lead 120 so that an external device is electrically connected with the circuit board via the conductive terminals 102 of the connector 50.

After the connector 50 is welded on the circuit board, the circuit board is disposed in the internal of an electronic device. At this time, the front half of the connector 50 is externally exposed from the electronic device for the external device to be connected with the connector 50. Thus, in order to beautify the entire appearance of the electronic device, the connector 50 externally exposed from the electronic device is required to have a colored appearance in a color similar to the casing of the electronic device.

Figure 2:
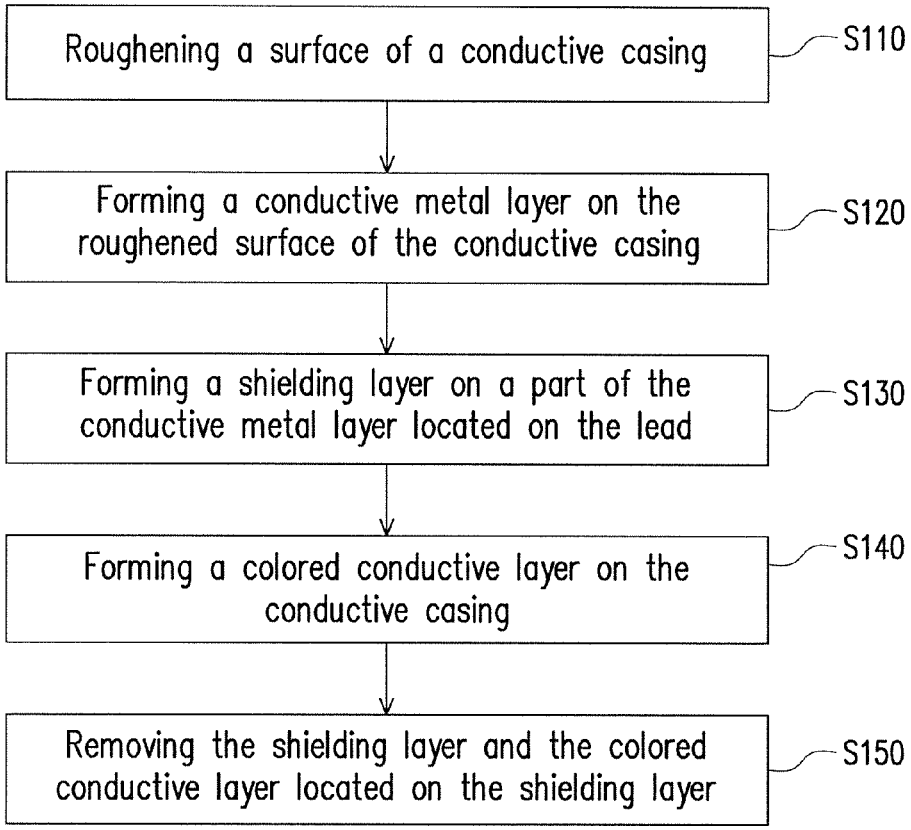
FIG. 2 is a flowchart illustrating a method of forming a colored appearance according to an embodiment of the application.
Figure 3A:
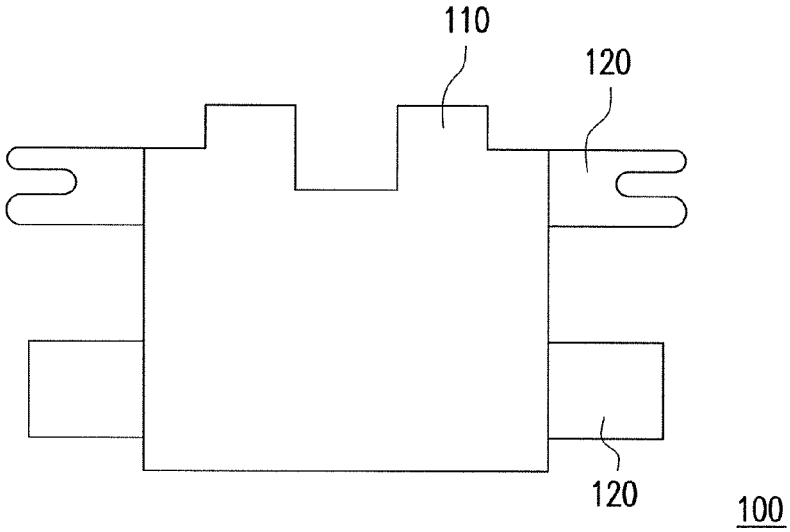
FIG. 3A through FIG. 3E illustrate the process of forming the colored appearance for the conductive casing depicted in FIG. 1.
Figure 3B:
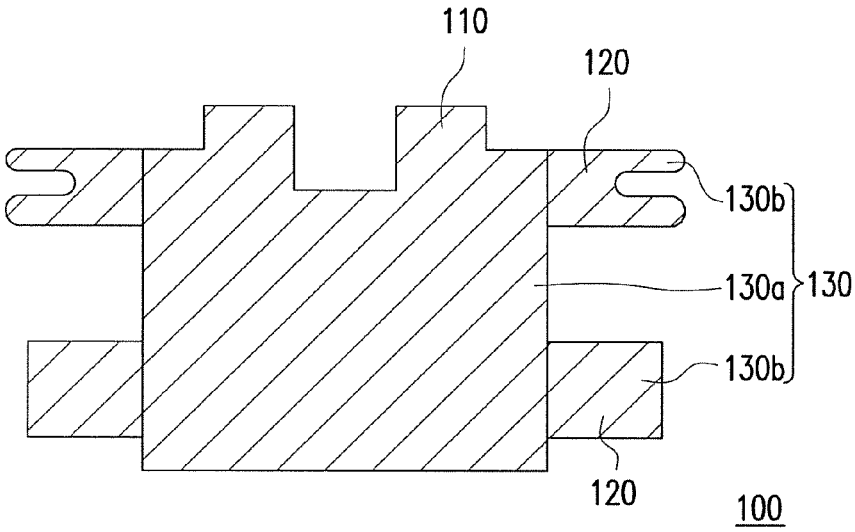
Figure 3C:
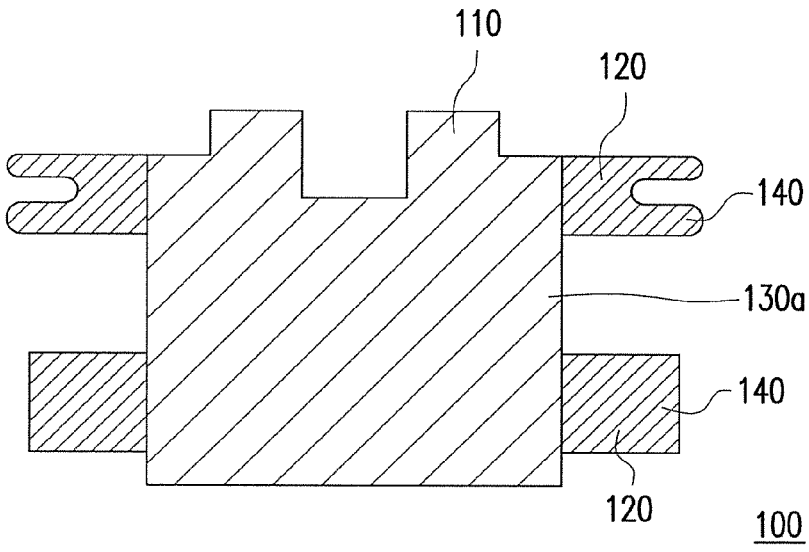
Figure 3D:
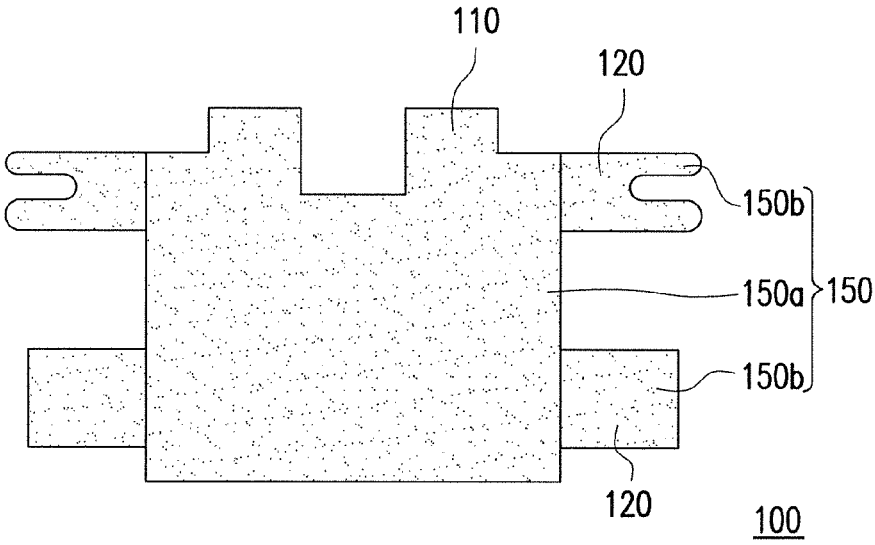
Figure 3E:
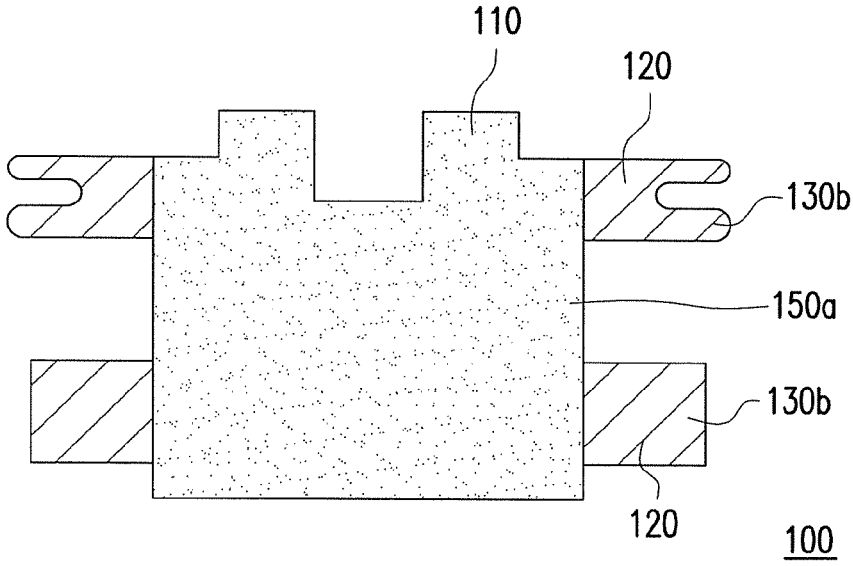

FIG. 2 is a flowchart illustrating a method of forming a colored appearance according to an embodiment of the application. FIG. 3A through FIG. 3E illustrate the process of forming the colored appearance for the conductive casing depicted in FIG. 1. FIG. 3A through FIG. 3E sequentially illustrate the process of forming the colored appearance for the conductive casing 100 depicted in FIG. 1. For more clear illustration, FIG. 3A through FIG. 3E show schematic top views of the conductive casing 100 depicted in FIG. 1, of which a part of elements are omitted. Hereinafter, the method of forming the colored appearance for the connector 50 according to the present embodiment will be sequentially described with reference to FIG. 2 with FIG. 3A through FIG. 3E.

First, in step S110, a surface of the conductive casing 100 is roughened. Referring to FIG. 2 with FIG. 3A, in the present embodiment, a material of the conductive casing 100 is stainless steel, but the application is not limited thereto. The surface of the conductive casing 100 is roughened so that the surface of the conductive casing 100 is suitable for attaching a material for forming the colored appearance.

Next, in step S120, a conductive metal layer 130 is formed on the roughened surface of the conductive casing 100. Referring to FIG. 2 with FIG. 3B, in the present embodiment, a method of forming the conductive metal layer 130 on the conductive casing 100 is to attach the conductive metal layer 130 on the surface of the conductive casing 100 by electroplating. The surface of the conductive casing 100 is roughened in advance so that the conductive metal layer 130 is evenly attached to the surface of the conductive casing 100. At this time, a part of the conductive metal layer 130*a* is located on the body 110 of the conductive casing 100, while the other part of the conductive metal layer 130*b* is located on the lead 120 of the conductive casing 100. On the other hand, in the present embodiment, a material of the conductive metal layer 130 is gold. However, in other embodiments, a material of the conductive metal layer 130 may be silver, and the application is not limited thereto.

Then, in step S130, a shielding layer 140 is formed on the other part of the conductive metal layer 130*b* located on the lead 120. Referring to FIG. 2 with FIG. 3C, in the present embodiment, a method of forming the shielding layer 140 on the lead 120 is to coat a plating-resist material on the surface of the lead 120. At this time, the conductive metal layer 130*b* is already located on the lead 120, and thus, the shielding layer 140 is coated on the conductive metal layer 130*b*.

Afterward, in step S140, a colored conductive layer 150 is formed on the conductive casing 100. Referring to FIG. 2 with FIG. 3D, in the present embodiment, the colored conductive layer 150 requires to have color and good conductivity so that the conductive casing 100 has color and good conductivity after the colored conductive layer 150 is formed on the conductive casing 100. Thus, a material of the colored conductive layer 150 may be a material with color and conductivity, such as metal or conductive rubber.

When a material of the colored conductive layer 150 is metal, a method of forming the colored conductive layer 150 on the conductive casing 100 is to attach the colored conductive material on the surface of the conductive casing 100 by electroplating. In the present embodiment, a material of the colored conductive layer 150 is black nickel so that the colored conductive layer 150 is a black-colored conductive layer. Further, in other embodiments, when a material of the colored conductive layer 150 is ruthenium, the colored conductive layer 150 is also a black-colored conductive layer, but the application is not limited thereto. The conductive casing 100 now has a block-colored appearance.

However, in other embodiments of the application, any other appropriate material may be selected for the colored conductive layer 150 according to color as required for the conductive casing 100. For example, when the conductive casing 100 requires being silver-colored, a material selected for the colored conductive layer 150 may be rhodium or palladium. When the conductive casing 100 requires being yellow-colored, a material selected for the colored conductive layer 150 may be Au—Ag alloy. When the conductive casing 100 requires being pink-colored, a material selected for the colored conductive layer 150 may be Au—Cu alloy. The application is not limited to the above.

In the present embodiment, a method of forming the colored conductive layer 150 on the conductive casing 100 is to attach black nickel on the surface of the conductive casing 100 by electroplating. The black nickel is black-colored and has good conductivity. Thus, by electroplating the black nickel on the surface of the conductive casing 100, the conductive casing 100 has good conductivity and a black-colored appearance. At this time, the entire appearance of the conductive casing 100 is in black, wherein a part of the colored conductive layer 150*a* is located on the conductive metal layer 130*a* on the body 110, while the other part of the colored conductive layer 150*b* is located on the shielding layer 140 on the lead 120.

Lastly, in step S150, the shielding layer 140 and the other part of the colored conductive layer 150*b* located on the shielding layer 140 is removed to expose the other part of the conductive metal layer 130*b* located on the lead 120. Referring to FIG. 2 with FIG. 3E, in the present embodiment, after electroplating the black nickel on the surface of the conductive casing 100 to allow the entire appearance of the conductive casing 100 in black, the shielding layer 140 located on the lead 120 is removed. At this time, the other part of the colored conductive layer 150*b* located on the shielding layer 140 is also removed at the same time to expose the other part of the conductive metal layer 130*b* located on the lead 120.

Figure 4:
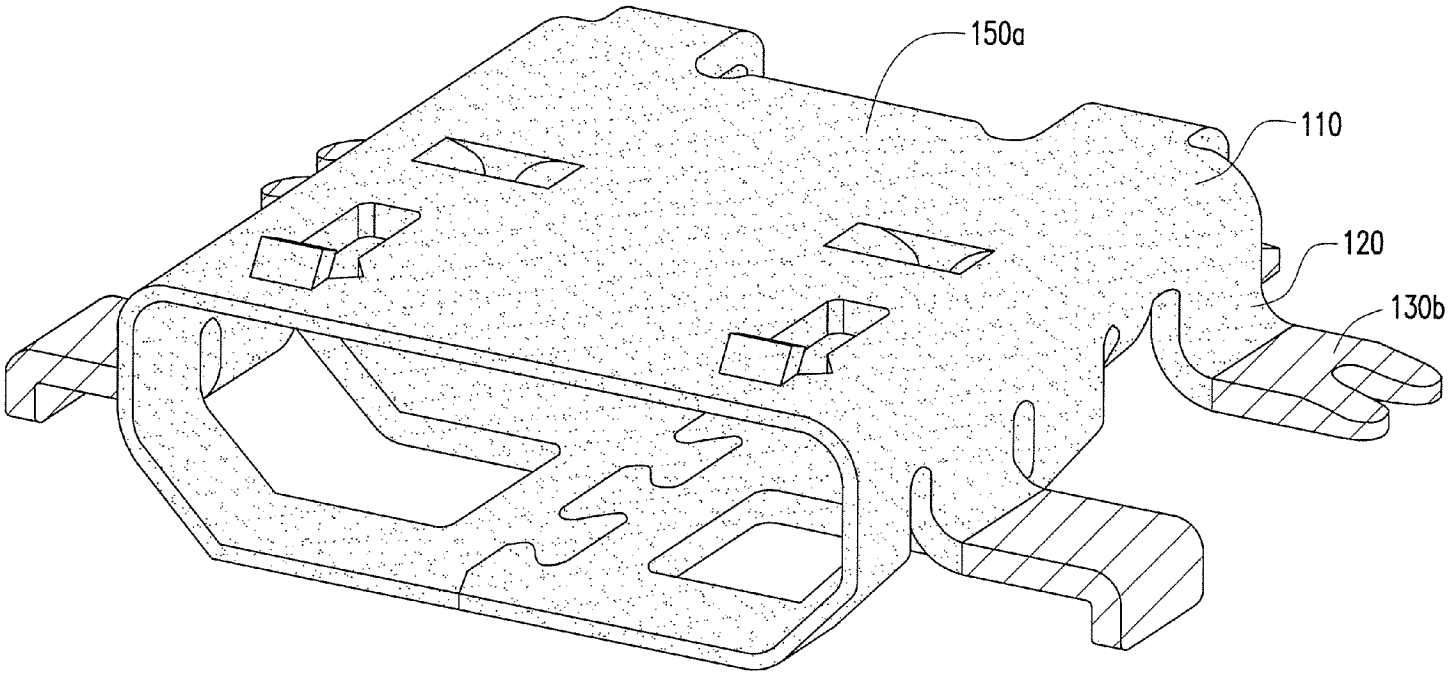
FIG. 4 is a perspective view showing the conductive casing of the connector depicted in FIG. 1 added with the colored appearance.

FIG. 4 is a perspective view showing the conductive casing of the connector depicted in FIG. 1 added with the colored appearance. Referring to FIG. 4, the conductive metal layer 130 is located on the conductive casing 100, wherein the part of the conductive metal layer 130*a* is located on the body, while the other part of the conductive metal layer 130*b* is located on the lead 120. The part of the colored conductive layer 150*a* is located on the body 110 and covers the part of the conductive metal layer 130*a* located on the body 110. Thus, when the conductive casing 100 of the present embodiment is provided with the colored appearance formed by the method of forming the colored appearance, the outermost layer of the body 110 of the conductive casing 100 is the part of the colored conductive layer 150*a*, and the outermost layer of the lead 120 of the conductive casing 100 is the other part of the conductive metal layer 130*b*. The body 110 of the conductive casing 100 now has a colored appearance and good conductivity. In the meantime, by removing the other part of the colored conductive layer 150*b* from the lead 120 of the conductive casing 100, the other part of the conductive metal layer 130*b* with better weldability is exposed so that the lead 120 of the conductive casing 100 also has good weldability.

Accordingly, in step S130, the purpose of forming the shielding layer 140 on the lead 120 is to remove the colored conductive layer 150 located on the lead 120 after forming the colored conductive layer 150 on the conductive casing 100, so as to prevent the weldability of the lead 120 being influenced by the colored conductive layer 150 located on the lead 120.

Thus, after the colored appearance is formed for the conductive casing 100 by the method of forming the colored appearance according to the application, the conductive terminals 102 and the insulation body 104 may be disposed inside the conductive casing 100 so that the connector 50 depicted in FIG. 1 has the colored appearance. The connector 50 may be welded on the circuit board through the lead 120 located on the conductive casing 100. The other part of the conductive metal layer 130*b* on the lead 120 has good weldability so that the connector 50 may be stably fixed on the circuit board. At this time, a part of the connector 50 which is externally exposed from the electronic device has a colored appearance similar to the appearance of the electronic device. Meanwhile, the connector 50 has good conductivity so as to maintain the function of the connector 50 for being electrically connected with the external device.

In addition, referring to FIG. 4, in the present embodiment, the part of the colored conductive layer 150*a* of the conductive casing 100 is located on the body 110 and a part of the lead 120, while the conductive metal layer 130*b* is exposed on the other part of the lead 120. In detail, by steps S110 and S120 after the conductive metal layer 130 is electroplated on the surface of the conductive casing 100, in step S130, the shielding layer 140 (not shown) is merely formed on a part of the lead 120 for the conductive casing 100. Therefore, by steps S140 and S150, a colored material layer 150 is formed on the conductive casing 100, and the shielding layer 140 is removed, so that the conductive metal layer 130*b* on a part of the lead 120 is exposed.

At this time, another part of the lead 120 has the colored conductive layer 150*a*, but the lead 120 still has good weldability, and the conductive casing 100 also has a colored appearance and good conductivity. In other words, the application is not intent to limit the colored conductive layer on the lead to being completely removed. The lead can stably welded on the circuit board as long as the part of the lead welded on the circuit board does not have the colored conductive layer, i.e. the conductive metal layer is exposed from the part of the lead welded on the circuit board.

Based on the above, the present application provides a method of forming a colored appearance, by which a conductive metal layer is formed on a roughened surface of a conductive casing for a connector, a shielding layer is formed on a part of the conductive metal layer located on at least one lead. After forming the shielding layer on the part of the conductive metal layer, the colored conductive layer is formed on the conductive casing. Lastly, the shielding layer and the part of the colored conductive layer on the shielding layer are removed from the lead so as to expose the part of conductive metal layer on the lead. Accordingly, the conductive casing of the connector has a colored appearance and good conductivity, and the lead thereof has good weldability for the connector to be welded on the circuit board through the lead.

Although the application has been described with reference to the above embodiments, it will be apparent to one of the ordinary skill in the art that modifications to the described embodiment may be made without departing from the spirit of the application. Accordingly, the scope of the application will be defined by the attached claims not by the above detailed descriptions.

What is claimed is:

1. A method of forming a colored appearance, suitable for forming a colored appearance for a conductive casing of a connector, wherein the conductive casing comprises a body and at least one lead, the lead extends from the body, and the conductive casing is suitable for being welded on a circuit board through the lead, the method of forming the colored appearance comprising:

roughening a surface of the conductive casing;

forming a conductive metal layer on the roughened surface of the conductive casing;

forming a shielding layer on a part of the conductive metal layer located on the lead;

forming a colored conductive layer on the conductive casing, wherein a part of the colored conductive layer is located on the conductive metal layer of the body, and the other part of the colored conductive layer is located on the shielding layer located on the lead; and removing the shielding layer and the part of the colored conductive layer located on the shielding layer to expose the other part of the conductive metal layer located on the lead.

2. The method of forming the colored appearance according to claim 1, wherein the step of forming the conductive metal layer comprises electroplating the conductive metal layer.

3. The method of forming the colored appearance according to claim 1, wherein the step of forming the shielding layer comprises coating a plating-resist material.

4. The method of forming the colored appearance according to claim 1, wherein a material of the colored conductive layer comprises metal.

5. The method of forming the colored appearance according to claim 1, wherein a material of the colored conductive layer comprises black nickel.

6. The method of forming the colored appearance according to claim 4, wherein the step of forming the colored conductive layer comprises electroplating a colored conductive material.

7. The method of foaming the colored appearance according to claim 1, wherein a material of the conductive metal layer comprises gold or silver.

8. A conductive casing, suitable for a connector and having a colored appearance, the conductive casing comprising:

a body;

at least one lead, extending from the body, wherein the conductive casing is suitable for being welded on a circuit board through the lead;

a conductive metal layer, located on the conductive casing, wherein a part of the conductive metal layer is located on the body, and the other part of the conductive metal layer is located on the lead; and a colored conductive layer, located on the body and covering the part of the conductive metal layer located on the body.

9. The conductive casing according to claim 8, wherein a material of the colored conductive layer comprises metal.

10. The conductive casing according to claim 8, wherein a material of the colored conductive layer comprises black nickel.

11. The conductive casing according to claim 8, wherein a material of the colored conductive layer comprises gold or silver.

* * * * *